US008785800B2

(12) United States Patent
Berdelle-Hilge

(10) Patent No.: US 8,785,800 B2
(45) Date of Patent: Jul. 22, 2014

(54) METHOD AND DEVICE FOR SORTING OBJECTS BY MEANS OF INTERMEDIATE STORAGE UNITS

(75) Inventor: Peter Berdelle-Hilge, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 5 days.

(21) Appl. No.: 13/578,685

(22) PCT Filed: Feb. 11, 2011

(86) PCT No.: PCT/EP2011/052071

§ 371 (c)(1),
(2), (4) Date: Oct. 18, 2012

(87) PCT Pub. No.: WO2011/098585

PCT Pub. Date: Aug. 18, 2011

(65) Prior Publication Data

US 2013/0134075 A1 May 30, 2013

(30) Foreign Application Priority Data

Feb. 12, 2010 (DE) ..... 10 2010 007 741

(51) Int. Cl.
*B07C 5/00* (2006.01)

(52) U.S. Cl.
USPC ..... 209/583

(58) Field of Classification Search
USPC ..... 209/583, 584, 900; 700/224, 226
See application file for complete search history.

(56) References Cited

U.S. PATENT DOCUMENTS

| | | | |
|---|---|---|---|
| 5,158,183 | A | 10/1992 | Beerman et al. |
| 5,433,325 | A | 7/1995 | Levaro et al. |
| 5,799,800 | A | 9/1998 | Lux |
| 6,793,063 | B1 | 9/2004 | Gillet et al. |
| 7,405,375 | B2 | 7/2008 | Hanson |
| 7,820,932 | B2 | 10/2010 | Stemmle |
| 8,178,811 | B2 | 5/2012 | Bergelle-Hilge |

(Continued)

FOREIGN PATENT DOCUMENTS

| | | | |
|---|---|---|---|
| DE | 2 945 386 | A1 | 5/1980 |
| DE | 10 2007 058 581 | A1 | 6/2009 |

(Continued)

OTHER PUBLICATIONS

German Patent and Trademark Office Search Report, Dated Feb. 19, 2010.

*Primary Examiner* — Kaitlin Joerger
(74) *Attorney, Agent, or Firm* — Laurence A. Greenberg; Werner H. Stemer; Ralph E. Locher

(57) ABSTRACT

A method and a device sort objects, in particular flat postal items, by use of intermediate storage units. A feed transport unit transports the objects to a series of a multiple of intermediate storage units which are connected in parallel. Each object is transported into an intermediate storage unit in accordance with the respectively measured value of a sorting feature. Later, each intermediate storage unit is emptied, and a removal transport unit transports the objects away. Each intermediate storage unit is emptied at the latest when the last object in the series of objects transported in the feed transport unit has been transported into the intermediate storage unit or when the object has been transported past the feed connecting path to the intermediate storage unit.

10 Claims, 2 Drawing Sheets

(56) References Cited

U.S. PATENT DOCUMENTS

| | | | |
|---|---|---|---|
| 2004/0251179 | A1 | 12/2004 | Hanson et al. |
| 2007/0102328 | A1 | 5/2007 | Hanson et al. |
| 2007/0151904 | A1 | 7/2007 | Hanson et al. |
| 2008/0011653 | A1 | 1/2008 | Stemmle |
| 2009/0145819 | A1 | 6/2009 | Zimmermann |
| 2009/0211952 | A1 | 8/2009 | Berdelle-Hilge |

FOREIGN PATENT DOCUMENTS

| | | | |
|---|---|---|---|
| DE | 10 2008 006 752 | A1 | 8/2009 |
| EP | 0654309 | A1 | 5/1995 |
| EP | 0 429 118 | B1 | 5/1996 |
| EP | 0 723 483 | B1 | 8/1998 |
| EP | 1 227 897 | B1 | 9/2003 |
| EP | 1 878 511 | A1 | 1/2008 |
| FR | 2440785 | A1 | 6/1980 |

METHOD AND DEVICE FOR SORTING OBJECTS BY MEANS OF INTERMEDIATE STORAGE UNITS

BACKGROUND OF THE INVENTION

Field of the Invention

The invention relates to a method and a device for sorting objects, in particular flat postal items, by means of intermediate storage units.

A method having the features of the preamble of claim 1 and a device having the features of the preamble of claim 8 are known from EP 1878511 A1.

EP 1878511 A1 describes a sorting system and a sorting method for sorting objects in accordance with a predefined sequence of target points ("destination addresses"). The objects are flat postal items for example, and each object is held individually during the sorting process, for example by a clamp.

The sorting system of EP 1878511 A1 has a plurality of sorting modules. Each sorting module has an input transport path, a series of intermediate storage units, and an output transport path. In one configuration, a "batch sorting module" and, downstream, an "address sorting module" are connected in succession. The "batch sorting module" receives unsorted objects, of which the target points have already been read. A stack is formed in each intermediate storage unit and consists of all objects each having one of 25 target points assigned to this intermediate storage unit. The objects are sorted randomly within such a stack. The intermediate storage units are emptied again in succession, and the stacks are transported in succession to the "address sorting module". There, the objects are again distributed among the storage units. The objects leave the "address sorting module" in accordance with the predefined sequence of target points.

DE 10 2007 058 581 A1 describes a sorting system for flat postal items, said system having a plurality of storage modules 40*a* to 44*b* arranged in parallel. The storage modules 40*a* to 44*b* can be filled via two parallel feed transport paths and emptied via two parallel removal transport paths. Each storage module 40*a* to 44*b* is selectively filled with postal items ("stacking mode") or is emptied of postal items by removing individual postal items from the storage module ("separating mode"). In one embodiment, six storage modules 40*a*, 40*b*, 42*a*, 42*b*, 44*a*, 44*b* are arranged in parallel. Two parallel feed transport paths feed postal items, and two parallel removal transport paths transport postal items away. In a first period, four storage modules 40*a*, 40*b*, 44*a*, 44*b* are filled up to a predefined fill level. In a subsequent second period, further postal items, which are fed, are transported into the two storage modules 44*a* and 44*b* and into the other two storage modules 42*a*, 42*b*. At the same time, the storage modules 40*a*, 40*b* are emptied. In a subsequent third period, further postal items are transported to the four storage modules 40*a*, 40*b*, 42*a*, 42*b*, where they are stacked, and at the same time the sorting modules 44*a*, 44*b* are emptied. This switching process is continued. All storage modules are thus filled and emptied again and filled again and emptied again and so on in succession. The storage modules 40*a*, 40*b*, 42*a*, 42*b*, 44*a*, 44*b* are thus filled and emptied depending on their respective fill levels.

DE 10 2008 006 752 A1 describes a sorting system for flat postal items. The postal items are to be sorted by delivery point in accordance with a route (see the arrangement of FIG. 1 and FIG. 2). Four ejection guides AS-1, . . . , AS-4 are arranged along a feed conveyor path. Each ejection guide allows postal items to be ejected from the conveyor path Fs. In the embodiment of FIG. 1, the postal items are distributed among four output devices AE-1, . . . , AE-4. In the embodiment of FIG. 2, the postal items are distributed among four stacking devices SB-1, . . . , SB-4. Each stacking device SB-1, . . . , SB-4 produces a stack of postal items and then ejects this stack to a specific location in a removal transport path Tp. A series of stacks and individual postal items is thus formed in the removal transport path. The removal transport path Tp transports this stack and individual postal items to an output device AE. In one embodiment, a first batch of postal items is first distributed among the stacking devices SB-1, . . . , SB-4, namely all postal items which have been ejected into a first output device AE-1 in a previous sorting process. A second batch of postal items is then distributed among the four stacking devices SB-1, . . . , SB-4, namely the postal items from the output device AE-2, and so on.

Devices for sorting objects are also described in DE 2945386 C2 and in EP 0429118 B1. These devices each have a feed transport path, a multiplicity of intermediate storage units arranged in parallel, and a removal transport path. In EP 0429118 B1, an arrangement with a plurality of rows of intermediate storage units arranged in parallel is described.

EP 1227897 B1 describes a device which mixes two presorted stacks of postal items ("merging") so that a single series of postal items is produced, these postal items being sorted in accordance with a sorting feature (in this case: the delivery address). The device has two separators ("destacking units D1, D2", see FIG. 1) for the two stacks ("batches L1, L2"). A feed transport path ("conveyors C1, C2") leads from each separator D1, D2 to a plurality of intermediate storage units ("storage loops M11, M12, M21, M22", see FIG. 1) arranged in parallel. A single removal transport path ("conveyor CS") leads away from the intermediate storage units M11, . . . , M22. After the separation process, the postal items are divided among the intermediate storage units M11, . . . , M22 in such a way that N1/2 postal items from L1 reach M11 and further N1/2 postal items from L1 reach M12. Accordingly, N1/2 postal items from L2 reach M21 and N1/2 postal items from L2 reach M22. A control device ("control/command unit U") stores the respective sorting feature value for each postal item and also stores where and in which intermediate storage unit this postal item is located. The control unit U empties the intermediate storage units so that a single sequence of sorted postal items is produced in the removal transport path CS.

EP 0723483 B1 describes a sorting system and a sorting method, in which at least four collection zones are used for the intermediate storage of objects. For example, the objects are items of clothing on clothes hangers. A desired sequence in which the objects are to reach an output station is predefined. The objects are first transported from an input station to a first collection zone. The objects then pass through a second, third and fourth collection zone. A storage position in each collection zone is derived from the place number which an object is to have in the sequence. The object is transported in succession to the first, second and third collection zone and is stored in accordance with the respective storage position. The object is then transported to the output station. The objects thus reach the output station in the predefined sequence. Thanks to the method, fewer storage places are required than with a single storage device.

U.S. Pat. No. 5,433,325 and EP 654309 B1 describe a sorting system for flat postal items, said system comprising a feed transport path (in FIG. 2 the perpendicular transport path to the right), a plurality of intermediate storage units (arranged one above the other in FIG. 2), and a removal transport path (in FIG. 2 the perpendicular transport path to the left). In each case, a guide ("selector device 57") guides a postal item into an intermediate storage unit and/or leaves it in the feed transport path. Each intermediate storage unit is designed as an "accumulating unit 11". The respective delivery address or a sorting code on a postal item ("mail item 7") is read. The postal items 7 are divided among the parallel intermediate storage units 11 so that all postal items having the same sorting code or similar sorting codes reach the same intermediate storage unit 11. Each postal item 7 in an intermediate storage unit 11 is moved forward slightly when a further postal item 7 is guided into this intermediate storage unit from behind. A stack of overlapping postal items 7 is thus created in the intermediate storage unit 11. As soon as the postal item 7 at the front of this stack in the intermediate storage unit 11 has reached a light barrier 98, 99 at the exit of the intermediate storage unit, the intermediate storage unit is emptied.

In U.S. Pat. No. 7,405,375 B2, each object to be sorted is temporarily connected to a holder, for example by inserting the object into a pouch. An image of the object is produced beforehand, and a target point for the object is established. Each holder is assigned a sorting number, which is dependent on the sorting target of the object. A plurality of holders with objects is transported together by means of a carrier. In a second carrier, spaces which are still free are allocated for the object. Depending on the sorting number and the free spaces, the objects in the holders are passed into the second carrier in a sequence.

BRIEF SUMMARY OF THE INVENTION

The object of the invention is to provide a method having the features of the preamble as claimed and a device having the features of the preamble as claimed, said method and device reducing the residence time of objects in the intermediate storage units.

The object is achieved by a method having the features as claimed and by a device having the features as claimed. Advantageous embodiments are disclosed in the dependent claims.

In accordance with the solution, objects are sorted in accordance with a predefined sorting feature. The sorting device according to the solution comprises

- a measuring device,
- a feed transport device,
- a series of receiving devices,
- a series of intermediate storage units arranged in parallel, and,
- for each intermediate storage unit, a feed connection path from the feed transport device to the intermediate storage unit and a removal connection path from the intermediate storage unit to a receiving device.

For each object, the following steps are carried out:

- The measuring device measures the value for the sorting feature of this object.
- An intermediate storage unit is selected in accordance with the sorting feature value.
- The feed transport device transports the object to the feed connection path leading to the selected intermediate storage unit.
- The object is redirected into this feed connection path.
- The feed connection path transports the object to the selected intermediate storage unit.
- Later, the intermediate storage unit is suddenly emptied completely. The removal connection path of the intermediate storage unit transports all objects located in the intermediate storage unit.
- The removal transport device transports the object away.

The feed transport device transports the objects in such a way that a sequence of the transported objects is formed.

The following is carried out for each intermediate storage unit: The process of emptying this intermediate storage unit is triggered, at the latest, when at least one of the following events occurs:

- The last object in the series of objects transported in the feed transport device has been transported into this intermediate storage unit because this intermediate storage unit was selected for the sorting feature value of this object.
- The last object in the series of objects transported in the feed transport device has been transported past the feed connection path to this intermediate storage unit because a subsequent intermediate storage unit in the series of intermediate storage units was selected for the sorting feature value of this object.

This intermediate storage unit can be emptied immediately after the trigger or at a later point after the trigger.

Each intermediate storage unit is emptied in such a way that the objects located in this intermediate storage unit before emptying are arranged in the same sequence after emptying, and are now arranged in a receiving device and no longer in the intermediate storage unit.

Thanks to the invention, it is not necessary to define an emptying fill level for an intermediate storage unit and to only empty the intermediate storage unit once this emptying fill level has been reached. Furthermore, it is not necessary to define a specific time at which an intermediate storage unit is to be emptied. In addition, time is saved compared to the approach of only emptying the intermediate storage unit once all objects have been distributed among the intermediate storage units.

Thanks to the method according to the solution, each intermediate storage unit is available again for subsequent objects at an earlier moment in time. If the sorting feature values are distributed uniformly among the intermediate storage units and occur at equal frequency, each intermediate storage unit is thus available at an earlier moment in time, by a period which is half as long as the period required to transport all objects through the feed transport device. For example, this time saving can be used to transport the objects at a lower speed. This reduces scuffing of the objects as a result of the transport process and reduces the risk of damaging objects.

In accordance with the solution, an intermediate storage unit is emptied, at the latest, when the last object in the series in the feed transport device has either reached this intermediate storage unit or has passed the intermediate storage unit. Each of these events preferably triggers the procedure of emptying the intermediate storage unit.

The invention makes it possible to sort the objects in accordance with the sorting feature. A desired sequence of objects to be sorted can be produced with the aid of the series of intermediate storage units.

It is not necessary for the objects to already be sorted in the feed transport path. Rather, the objects can be fed in any sequence in the feed transport path and distributed among the intermediate storage units. In accordance with the solution, the objects are distributed among the intermediate storage units in accordance with the sorting feature. It is not necessary to make the filling and/or emptying of an intermediate storage unit dependent on a number of objects, for example the number N1 in EP 1227897 B1. Furthermore, it is not necessary to store the location in an intermediate storage unit at which a temporarily stored object is located.

It is not necessary for one object to pass another object in the feed transport device or in an intermediate storage unit, that is to say for one object to overtake another object.

In order to produce a desired sequence of the objects, the following parameters can be changed independently of one another:

- the selection of an intermediate storage unit for an object in accordance with the sorting feature, in particular the
- specification of a sorting plan, which assigns an intermediate storage unit to each possible sorting feature, and
- the sequence in which the intermediate storage units are emptied into the receiving devices.

It is possible to first empty intermediate storage unit no. j and to then empty intermediate storage unit no. i, although intermediate storage unit no. j is arranged downstream of intermediate storage unit no. i in the series. The sequence in which the intermediate storage units are emptied can be fixed independently of the arrangement of the intermediate storage units in the series. Increased versatility is thus achieved during the sorting process.

The invention makes it possible to empty the intermediate storage units in an event-driven manner. It is possible, although not necessary, to measure the transport speeds at which the objects are transported. The emptying of the intermediate storage units is triggered, however, by an event which can be measured using light barriers for example and of which the measurement does not require a tachometer.

The invention makes it possible, although not necessary, for each object to be provided with a clear identification. The sorting method according to the solution does not require knowledge of the current location of each object during the sorting process.

In one embodiment, the object which, at the start of the transport process, was in the feed transport device of the last object is continuously used as the "last object". Once this last object has been redirected into a feed connection path, a virtual future time at which this previously last object would reach a subsequent feed connection path is used. For example, this future time is therefore virtual because the object may already have been ejected beforehand. For example, this embodiment can be implemented easily if the feed transport device transports the objects at constant speed or at a speed proportional to a system clock.

The intermediate storage units are then unloaded in succession at regular intervals or in succession proportionally to the system clock. It is not necessary to follow the location and assigned intermediate storage unit of the respective last object.

In order to make the intermediate storage unit available early on by emptying, the respective current last object in the series in the feed transport device is preferably used as the last object. If the last object of this series is redirected into an intermediate storage unit, the previously penultimate object in this series or an object located further forward thus now becomes the last object. The event whereby the object which is now last is conveyed past a feed connection path to an intermediate storage unit B or reaches the intermediate storage unit B triggers the emptying of the intermediate storage unit B. When the object which was previously last reaches the intermediate storage unit A, this event triggers the emptying of the intermediate storage unit A. This embodiment does not require the transport speed of the feed transport device to be measured or controlled.

In a particularly advantageous embodiment, at least one intermediate storage unit Zw is already emptied if the last object G for this intermediate storage unit reaches this intermediate storage unit Zw. Each object located in the feed transport device behind this last object G for the intermediate storage unit Zw is thus transported into another intermediate storage unit because another intermediate storage unit is assigned to the sorting feature value of this object. As soon as the last object G has reached the intermediate storage unit Zw, the emptying of this intermediate storage unit Zw is thus triggered. The intermediate storage unit Zw is thus made available particularly early for a subsequent sorting task. It is possible to empty each intermediate storage unit as early as possible in this manner. The emptying sequence therefore generally differs from the sequence in which the intermediate storage units are arranged.

In one embodiment, the receiving devices are located in a removal transport device and are designed as receiving regions in this removal transport device. As soon as all intermediate storage units have been emptied, the objects are located in a specific sequence in the removal transport device. This sequence corresponds to the sequence in which the intermediate storage units are arranged. The removal transport device transports the objects away.

Another embodiment makes it possible to carry out a further sorting of the objects. A first sorting process is already implemented by dividing the objects among the intermediate storage units. In order to carry out a further sorting process, the receiving devices are designed as further intermediate storage units. The intermediate storage units are emptied as already described above, wherein all objects are transported from an intermediate storage unit into a receiving device (that is to say into a further intermediate storage unit). It is possible that objects from different intermediate storage units are transported into the same receiving device. Each receiving device discharges into a removal transport device. An emptying sequence of the receiving devices (that is to say of the further intermediate storage units) is predefined. This emptying sequence preferably differs from the sequence in which the receiving devices are arranged. The receiving devices are emptied into the removal transport device in accordance with the emptying sequence. The removal transport device transports the objects away from a receiving device or pushes the objects at least slightly forward. A sequence of the objects of different receiving devices can thus be produced, said sequence corresponding to the sequence in which the receiving devices are emptied.

In a continued development of this embodiment, a cascaded sorting system is created. The intermediate storage units are connected to the further intermediate storage units (the receiving devices) via an arrangement which has at least one connecting transport path. The intermediate storage units are emptied into the further intermediate storage units as described above, and more specifically as early as possible. The further intermediate storage units are also emptied subsequently, more specifically either likewise as early as possible or in accordance with a predefined sequence of emptying of the further intermediate storage units.

A sequence of removal from the intermediate storage units is preferably predefined. This sequence of removal may be the same as the sequence in which the intermediate storage units are arranged or may be different therefrom. The objects are transported from the intermediate storage units into the removal transport device in such a way that the sequence of objects coming from different intermediate storage units corresponds to the predefined sequence of removal from the intermediate storage units. An intermediate storage unit is preferably emptied as early as possible. So that the sequence of removal from the intermediate storage units is nevertheless observed, the objects are stored temporarily in the removal transport device or in removal connection paths as required.

For example, the objects to be sorted are postal items, banknotes, items of clothing, articles of luggage or credit cards.

The invention will be described hereinafter on the basis of an exemplary embodiment. In the figures:

DESCRIPTION OF THE INVENTION

In the exemplary embodiment, postal items (standard and large letters, postcards, catalogues, parcels and the like) are sorted. Each postal item is provided with details regarding a target address to which this postal item is to be transported. In the exemplary embodiment, these target address details act as the sorting feature, in accordance with which the postal items are to be sorted.

In one application, the postal items are sorted in an incoming sorting center with regard to routes ("delivery routes") of post deliverers ("carriers"). A number of routes are predefined for the area for which the incoming sorting center is responsible. Each route defines a series of a number of possible target points for postal items. In a pre-sorting process, the postal items arriving at the incoming sorting center within a period of time are divided among the various routes. Each batch of postal items for a respective route is then to be sorted in accordance with the predefined sequence of delivery points of this route. All postal items for a first route reach the sorting system according to the solution first, followed by the postal items for a second route, and so on. The sorting system according to the solution sorts all of these postal items. The sorting process should be as quick as possible, and postal items for different routes should not be mixed together. An intermediate storage unit of the sorting system is therefore to be emptied as early as possible so as to allow postal items for different routes to be sorted at the same time, without the postal items being mixed together.

The postal items are sorted by a sorting system.

This sorting system has

- a reading device,
- a feed transport device comprising a buffer device,
- a removal transport device,
- a series of sorting endpoints,
- a series of intermediate storage units arranged in parallel, and
- a control unit.

Figure 1:
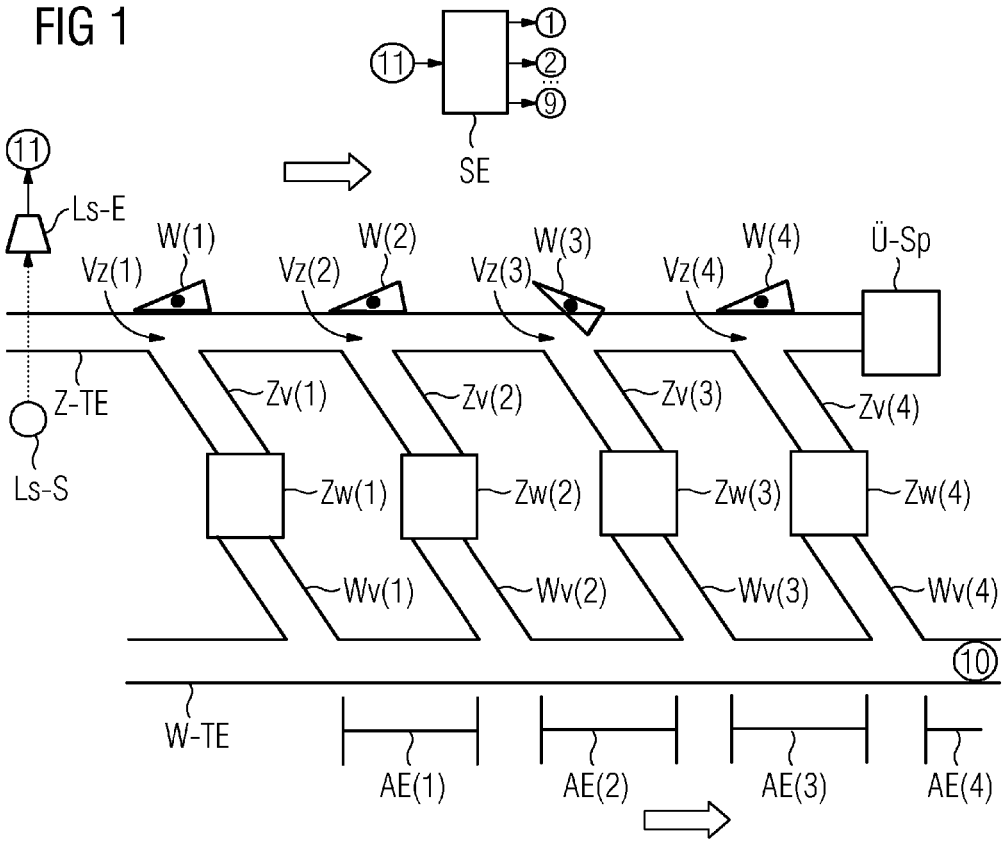
FIG. 1 shows a schematic view of the first cascade of an arrangement having four intermediate storage units and five sorting endpoints.
Figure 2:
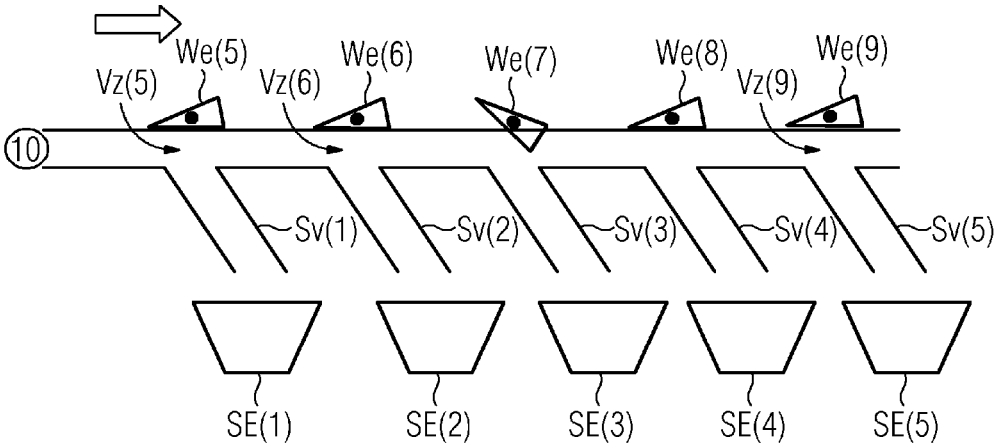
FIG. 2 shows the second cascade of an arrangement having four intermediate storage units and five sorting endpoints.

FIGS. 1 and 2 show schematic views of the two cascades of an arrangement having four intermediate storage units and five sorting endpoints. The following are illustrated:

- a feed transport device Z-TE comprising a buffer device (not shown),
- a removal transport device W-TE,
- a series of five sorting endpoints SE(1) to SE(5),
- a series of four intermediate storage units arranged in parallel Zw(1) to Zw(4) and
- a control device SE.

Both the feed transport device Z-TE and the removal transport device W-TE transport postal items in a direction of transport TR.

A plurality of receiving devices AE(1), AE(2), . . . is indicated in the removal transport device. Each receiving device AE(i) is designed as a receiving region in the removal transport device W-TE and allows the postal items to be received from the intermediate storage unit Zw(i) (i=1, 2, . . . ).

A feed connection path Zv(i) and a removal connection path are provided for each intermediate storage unit Zw(i). Four feed connection paths Zv(1) to Zv(4) and four removal connection paths Wv(1) to Wv(4) are shown in FIG. 1. Four guides W(1) to W(4) are arranged in the feed transport device Z-TE. Four branch points Vz(1) to Vz(4) are thus formed.

In addition, an overflow store Ü-Sp is arranged in the feed transport device Z-TE. In one embodiment, the overflow store Ü-Sp is likewise emptied into the removal transport device W-TE. An additional connection path leads from the overflow store Ü-Sp into the removal transport device W-TE. In another embodiment, the overflow store Ü-Sp is emptied manually or by means of a handling automaton.

The respective feed connection path ZV(i) branches off from the feed transport device Z-TE and runs into the intermediate storage unit Zw(i). A series of branch points are provided in the feed transport device Z-TE, namely one branch point Vz(i) per branching feed connection path Zv(i). A guide W(i) of the branch points redirects an object either into the feed connection path or leaves the object in the feed transport device Z-TE.

The respective removal connection path Wv(i) leads from the intermediate storage unit Zw(i) into the removal transport device W-TE. A series of discharge points are provided in the removal transport device W-TE, namely one discharge point per discharging removal connection path Wv(i).

In each case, one sorting endpoint connection path Sv(i) per sorting endpoint SE(j) branches off from the removal transport device W-TE and leads to the sorting endpoint SE(j).

Five sorting endpoint connection paths Sv(1) to Sv(5) from the removal transport device W-TE to the five sorting endpoints SE(1) to SE(5) are shown in FIG. 2.

The reading device comprises a camera and an image evaluation unit. The camera produces at least one image of the postal item. This image shows the target point details on the postal item. The image evaluation unit evaluates the image. An OCR (optical character recognition) unit first attempts to automatically decipher the target point details.

If this is unsuccessful, an operator reads the target point details and inputs them, at least in part, into a data detection station ("video coding station"). In one embodiment, a screen device displays the image. In another embodiment, the postal item is transported past the operator.

An intermediate storage unit Zw(i) and a sorting endpoint SE(j) are assigned to each possible target address SE(j). These assignments are stored in a sorting plan available on a computer. Each postal item Ps is passed by the camera and transported to the buffer device ("delay line"). A postal item Ps remains in this buffer device until the image evaluation unit has deciphered the target point details on the postal item Ps.

The control unit SE evaluates the sorting plan and selects an intermediate storage unit Zw(i) and a sorting endpoint SE(j) depending on the deciphered target point details. The feed transport device Z-TE transports the postal item Ps to the branch point Vz(i) leading to the intermediate storage unit Zw(i) selected by the control unit SE for this postal item Ps. The guide W(i) of the branch point Vz(i) redirects the postal item Ps into the feed connection path Zv(i) to the selected intermediate storage unit Zw(i). The feed connection path transports the postal item Ps to the selected intermediate storage unit Zw(i).

At a separate moment, the intermediate storage unit Zw(i) is emptied. All postal items in the intermediate storage unit Zw(i), that is to say even the postal item Ps, are transported from the removal connection path Wv(i) to the discharge point. The removal transport device W-TE transports the postal item Ps to the sorting endpoint connection path SV(i) leading to the selected sorting endpoint SE(j).

In the embodiment with route sorting, an intermediate storage unit receives successive postal items for target points within a route. As soon as it has been established that no further postal items are arriving for this route, this intermediate storage unit is emptied and is available for postal items of a subsequent route. Only during the sorting process is it established when each specific intermediate storage unit will be emptied. This is dependent on the target points actually provided on the incoming postal items.

In the exemplary embodiment, a stack of upright postal items is formed in each sorting endpoint SE(1), SE(2), . . . . The stack of postal items stands for example on a base of the respective sorting endpoint. It is also possible for each sorting endpoint to comprise a support surface for a container and for the sorting system to eject the postal items directly into the container.

In the exemplary embodiment, both the feed transport device Z-TE and the removal transport device W-TE transport the postal items in such a way that a sequence of the transported postal items is produced and observed in each case. For example, each postal item is clamped between two endless conveyor belts, which rotate at the same speed and thus transport the postal items at this speed.

In the exemplary embodiment, each intermediate storage unit Zw(i) operates by the "first in/first out" (FIFO) principle. The postal items are pushed through the intermediate storage unit Zw(i), without overtaking one another.

In one embodiment, a spacing is provided between two successive postal items whilst these postal items are being transported. In another embodiment, the postal items are transported in such a way that two successive postal items overlap in part. It is also possible for each postal item to be connected temporarily to a holder ("escort") during the transport process. For example, this holder is a "clamp", to which the postal item is fastened during the transport process, or a storage pouch, in which the postal item is placed or positioned. It is also possible for a horizontal endless conveyor belt to transport postal items arranged on the endless conveyor belt.

The postal items can also be transported in an intermediate storage unit Zw(i) by endless conveyor belts in such a way that postal items overlap in part or are spaced from one another. It is also possible for each postal item to be held by a clamp or by a storage pouch ("escort") whilst the postal item is located in the intermediate storage unit Zw(i). Each postal item is preferably grasped permanently over its path via the feed transport device Z-TE, an intermediate storage unit Zw(i) and the connection paths Zv(i) and Wv(i) as well as the removal transport device W-TE.

In the exemplary embodiment, there are fewer sorting endpoints SE(1), . . . than possible target points. The postal items therefore should not only reach the correct sorting endpoint SE(1), . . . after the sorting process. In addition, the postal items which have been ejected into the same sorting endpoint should be located in the sorting endpoint in a specific sequence, after the ejection process. This sequence depends on a sequence of possible target points.

"Sequencing" is thus carried out in the exemplary embodiment.

A subsequent postal item cannot overtake a preceding postal item in the removal transport device W-TE, and a sequence of postal items produced in the sorting endpoint SE(j) can only be changed with difficulty and in a highly complex manner. The sequence of postal items in a sorting endpoint SE(1), . . . is thus produced by means of the intermediate storage units Zw(1), . . . . For example, all postal items from an intermediate storage unit Zw(k) are transported first into a sorting endpoint SE(j), and then all postal items from a further intermediate storage unit Zw(i) are transported into this sorting endpoint SE(j). All postal items from the intermediate storage unit are located first in the sorting endpoint SE(j) after the ejection process, and are then followed by those from the further intermediate storage unit.

In order to ensure this, a sequence of removal from the intermediate storage units Zw(1), Zw(2), . . . is predefined. This sequence of removal may coincide with the sequence of intermediate storage units or may differ therefrom. The postal items from an intermediate storage unit Zw-A are transported into the removal transport device W-TE at the same time as the postal items from the intermediate storage units arranged before this intermediate storage unit Zw-A in the sequence of removal, or after the postal items from these preceding intermediate storage units. The intermediate storage units Zw(1), . . . are thus emptied at the same time or in succession in accordance with the sequence of removal. The postal items are thus located in the removal transport device W-TE in accordance with the sequence of removal. The removal transport device W-TE continues to transport postal items sorted in this way without one postal item overtaking another postal item.

As already demonstrated, a series of postal items passes through the feed transport device Z-TE and reaches the first branch point Vz(1). The transport speed at which the feed transport device Z-TE transports the postal items is regulated or controlled and/or measured. In addition, at least one light barrier takes a measurement when a postal item passes the light barrier. The control unit SE therefore "knows" when and where each postal item is located in the feed transport device Z-TE.

A light barrier comprising a transmitter Ls-S and a receiver Ls-E is shown in FIG. 1. This light barrier is located before the first branch point Vz(1).

Each postal item first reaches the first branch point Vz(1). The control unit SE decides whether or not the first intermediate storage unit Zw(1) is assigned to the target address of this postal item. If it is, the control unit actuates the guide W(1) of the first branch point Vz(1) such that the guide W(1) redirects the postal item into the feed connection path Zv(1) to the first intermediate storage unit Zw(1). Otherwise, the control unit SE actuates the guide W(1) such that the postal item remains in the feed transport device Z-TE. This decision for actuation is made by the control unit SE at the second branch point Vz(2), the third branch point Vz(3), the fourth branch point Vz(4), and at any further branch point(s) until the postal item has reached the branch point Vz(i) to the selected intermediate storage unit Zw(i).

In the exemplary embodiment, the sorting plan assigns an intermediate storage unit to each possible target address so that each postal item is redirected in an intermediate storage unit. Each postal item is thus redirected to an intermediate storage unit at the latest at the last branch point in a feed connection path. The sorting plan generally assigns the same sorting endpoint to different possible target addresses.

In one embodiment, each intermediate storage unit Zw(i) is emptied once the last postal item in the feed transport device Z-TE has passed the branch point Vz(i) to this intermediate storage unit Zw(i). A release signal is preferably triggered once the last postal item has passed the branch point Vz(i). An intermediate storage unit Zw(i) is emptied by transporting the postal items from the intermediate storage unit to the removal transport device W-TE via the removal connection path Wv(i). Once the release signal for an intermediate storage unit has been generated, the intermediate storage unit is emptied so that the sequence of removal from the intermediate storage units is observed.

In one embodiment, in which the sequence of removal is the same as the sequence of the intermediate storage units Zw(1), . . . , the intermediate storage unit Zw(i) is emptied immediately once the release signal has been generated. The postal items from this intermediate storage unit Zw(i) are transported from the removal connection path Wv(i) into the removal transport device W-TE, and remain in the removal transport device W-TE until all intermediate storage units have been emptied. Only then does the removal transport device W-TE transport all postal items away.

If the sequence of removal differs from the series of intermediate storage units, this sequence of removal can be produced in that the intermediate storage units are emptied in accordance with the sequence of removal and the removal transport device pushes forward individual stacks of postal items selectively.

An example illustrates the emptying of the intermediate storage units. In this simple example, the sorting system has four intermediate storage units in the sequence Zw(1), Zw(2), Zw(3), Zw(4). The feed transport device accordingly has four branch points Vz(1), Vz(2), Vz(3), Vz(4) arranged in succession. The feed transport device transports nine postal items Ps(1), Ps(2), . . . , Ps(9) to the first branch point Vz(1) in this sequence.

The sorting plan assigns the following intermediate storage units to the target addresses of these nine postal items:

Ps(1), Ps(6), Ps(9) Zw(1)
Ps(2) Zw(2)
Ps(4), Ps(8) Zw(3)
Ps(3), Ps(5), Ps(7) Zw(4).

The front edge of the postal item Ps(1) reaches the first branch point Vz(1) at the time T(1), and the front edge of the postal item Ps(2) reaches the first branch point Vz(1) at the time T(2). The front edge of Ps(i) generally reaches the first branch point Vz(1) at the time T(i) (i=1, . . . , 9).

The following sequence of events occurs:

T(1) Ps(1) reaches Vz(1),
T(2) Ps(2) reaches Vz(1), Ps(1) reaches Zw(1),
T(3) Ps(3) reaches Vz(1), Ps(2) reaches Vz(2), Ps(1) is fully in Zw(1),
T(4) Ps(4) reaches Vz(1), Ps(3) reaches Vz(2), Ps(2) reaches Zw(2),
T(5) Ps(5) reaches Vz(1), Ps(4) reaches Vz(2), Ps(3) reaches Vz(3), Ps(2) is fully in Zw(2),
T(6) Ps(6) reaches Vz(1), Ps(5) reaches Vz(2), Ps(4) reaches Vz(3), Ps(3) reaches Vz(4),
T(7) Ps(7) reaches Vz(1), Ps(6) reaches Zw(1), Ps(5) reaches Vz(3), Ps(4) reaches Zw(3), Ps(3) reaches Zw(4),
T(8) Ps(8) reaches Vz(1), Ps(7) reaches Vz(2), Ps(6) is fully in Zw(1), Ps(5) reaches Zw(4), Ps(4) is fully in Zw(3), Ps(3) is in Zw(4),
T(9) Ps(9) reaches Vz(1), Ps(8) reaches Vz(2), Ps(7) reaches Vz(3), Ps(5) is fully in Zw(4),
T(10) Ps(9) reaches Zw(1), Ps(8) reaches Vz(3), Ps(7) reaches Vz(4),
T(11) Ps(9) is fully in Zw(1), Ps(8) is fully in Zw(3), Ps(7) reaches Zw(4),
T(12) Ps(8) is fully in Zw(3), Ps(7) is fully in Zw(4).

Figure 3:
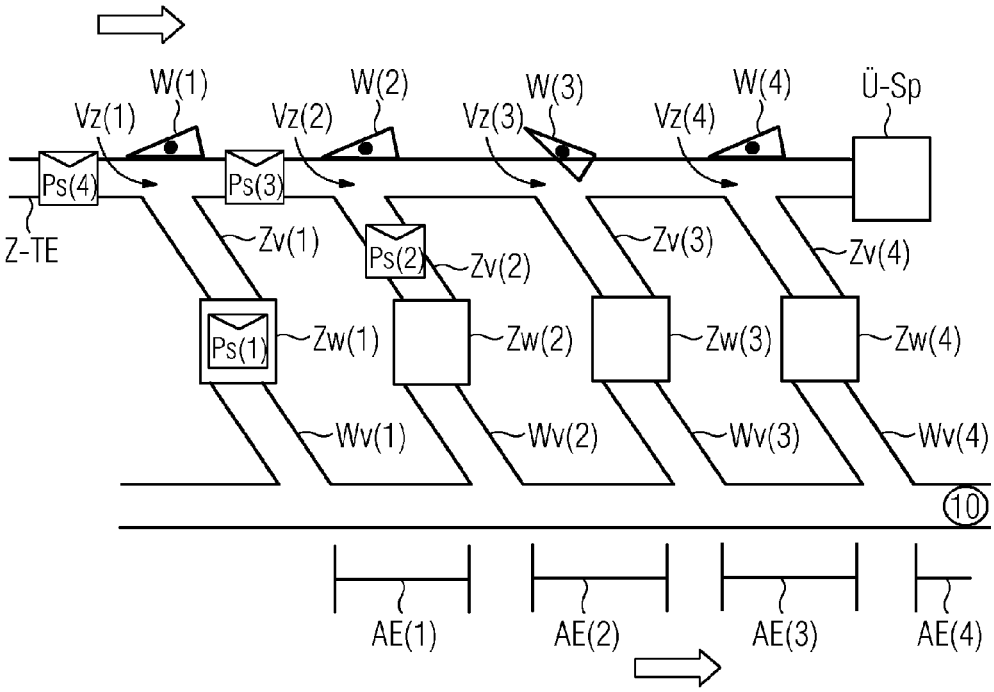
FIG. 3 shows the situation when sorting at moment T(4)

FIG. 3 shows the situation during sorting at time T(4).

Figure 4:
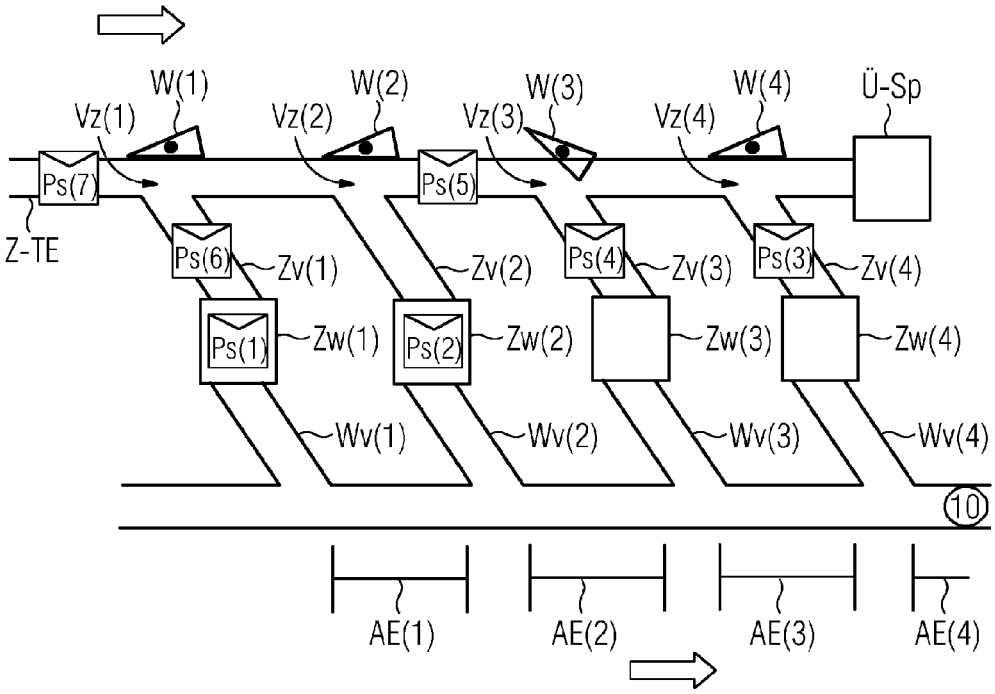
FIG. 4 shows the situation when sorting at moment T(7).

FIG. 4 shows the situation during sorting at time T(7).

The occupancies of the intermediate storage units at the respective times are as follows:

T(1) all intermediate storage units empty,
T(2) all intermediate storage units empty,
T(3) Zw(1):Ps(1)
T(4) Zw(1):Ps(1); Zw(2):Ps(2),
T(5) Zw(1):Ps(1); Zw(2):Ps(2),
T(6) Zw(1):Ps(1); Zw(2):Ps(2),
T(7) Zw(1):Ps(1); Zw(2):Ps(2),
T(8) Zw(1):Ps(1), Ps(6); Zw(2):Ps(2); Zw(3):Ps(4); Zw(4):Ps(3),
T(9) Zw(1):Ps(1), Ps(6); Zw(2):Ps(2); Zw(3):Ps(4); Zw(4):Ps(3), Ps(5),
T(10) Zw(1):Ps(1), Ps(6); Zw(2):Ps(2); Zw(3):Ps(4); Zw(4):Ps(3), Ps(5),
T(11) Zw(1):Ps(1), Ps(6), Ps(9); Zw(2):Ps(2); Zw(3): Ps(4); Zw(4):Ps(3), Ps(5),
T(12) Zw(1):Ps(1), Ps(6), Ps(9); Zw(2):Ps(2); Zw(3): Ps(4), Ps(8); Zw(4):Ps(3), Ps(5), Ps(7).

LIST OF REFERENCE SIGNS

| Reference sign | Meaning |
|---|---|
| AE(1), AE(2), . . . | receiving devices in the removal transport device W-TE |
| Ps, Ps(1), . . . , Ps(9) | postal items to be sorted |
| SE | control device |
| SE(1), SE(2), . . . | sorting endpoints |
| Sv(i) | sorting endpoint connection path to the sorting endpoint SE(i) (i = 1, 2, . . .) |
| T(1), T(2), . . . | times at which the front edge of a postal item Ps(1), Ps(2), . . . reaches a branch point Vz(1), Vz(2), . . . |
| Vz(1), Vz(2), . . . | branch points along the feed transport device Z-TE |
| Vz(i) | branch point in the feed transport device Z-TE, into which the feed connection path Zv(i) branches off |
| W(1), W(2), . . . | guides in the feed transport device Z-TE, belong to the branch points Vz(1), Vz(2), . . . |
| W(i) | guides in the branch point Vz(i) |
| Wv(i) | removal connection path from the intermediate storage unit Zw(i) to the removal transport device W-TE (i = 1, 2, . . .) |
| W-TE | removal transport device |
| Wv(1), Wv(2), . . . | removal connection path |
| Z-TE | feed transport device |
| Zv(1), Zv(2), . . . | feed connection path |
| Zw(1), Zw(2), . . . | intermediate storage units between the feed transport device Z-TE and the removal transport device W-TE |
| Zv(i) | feed connection path from the feed transport device Z-TE to the intermediate storage unit Zw(i) (i = 1, 2, . . .) |

The invention claimed is:

1. A method for sorting objects in accordance with a predefined sorting feature and using a sorting system, the sorting system containing a measuring device, a feed transport device, a series of a plurality of receiving devices, a series of a plurality of intermediate storage units disposed in parallel, and for each of the intermediate storage units a feed connection path from the feed transport device to the intermediate storage unit and a removal connection path from the intermediate storage unit to a receiving device, which method comprises the following steps of:

measuring for each of the objects, via the measuring device, a value of the sorting feature for an object;

selecting for each of the objects, an intermediate storage unit in accordance with the value of the sorting featured measured;

transporting each of the objects, via the feed transport device, to the feed connection path leading to the intermediate storage unit selected;

redirecting the object into the feed connection path;

transporting the object in the feed connection path to the intermediate storage unit selected;

subsequently transporting the object in an assigned removal connection path away from the intermediate storage unit selected to the receiving device;

transporting the objects, via the feed transport device, in such a way that a sequence of the objects transported is formed and for each of the intermediate storage units, the objects are transported from the intermediate storage unit into the receiving device such that all the objects from the intermediate storage unit are disposed directly one behind another in the receiving device;

detecting a last object in the sequence of the objects transported in the feed transport device;

triggering a procedure for emptying each of the intermediate storage units when the last object in the sequence of the objects transported in the feed transport device has been transported into the intermediate storage unit because the intermediate storage unit was selected for the sorting feature value of the object, or the object in the feed transport device has been transported past the feed connection path to the intermediate storage unit because a subsequent intermediate storage unit in a series of the intermediate storage units was selected for the sorting feature value of the object; and performing the emptying of the intermediate storage unit by transporting all of the objects in the intermediate storage unit in an assigned removal connection path to the receiving device.

2. The method according to claim 1, wherein if the last object of the sequence of the objects in the feed transport device is redirected into the feed connection path, once the last object has been redirected, the object now transported in the feed transport device as a last remaining object in the series is used as the last object.

3. The method according to claim 1, wherein for at least one of the intermediate storage units, an event whereby the last object in the sequence of the objects transported in the feed transport device, of which the sorting feature value is assigned to the intermediate storage unit, is redirected from the feed transport device into the intermediate storage unit and has reached the intermediate storage unit, triggers the step of emptying completely the intermediate storage unit.

4. The method according to claim 1, wherein a sequence of emptying of the intermediate storage units is predefined and includes the further step of:

transporting the objects from the intermediate storage units and into the removal transport device in such a way that the sequence of the objects coming from different ones of the intermediate storage units corresponds to the predefined sequence of removal from the intermediate storage units.

5. The method according to claim 4, which further comprises:

disposing at least one first intermediate storage unit in a series of the intermediate storage units upstream of a second intermediate storage unit; and predefining the sequence of emptying such that the second intermediate storage unit is emptied before the first intermediate storage unit.

6. The method according to claim 1, which further comprises emptying each of the receiving devices such that all the objects which have been transported from the at least one intermediate storage unit into the receiving device are transported into a removal transport device.

7. The method according to claim 6, wherein for each of the intermediate storage units, an event whereby the last object in the series in the feed transport device either reaches the intermediate storage unit or is transported past the feed connection path to the intermediate storage unit triggers the step of emptying the intermediate storage unit, the objects from the intermediate storage unit are transported to the removal transport device via the removal connection path, and the removal transport device then begins to transport the objects away as soon as possible, once all the objects from the intermediate storage units disposed in the removal sequence before the intermediate storage unit have reached the removal transport device.

8. A sorting system for sorting objects in accordance with a predefined sorting feature, the sorting system comprising:

a measuring device for detecting the objects;

a feed transport device;

a series of a plurality of receiving devices;

a control device;

a series of a plurality of intermediate storage units disposed in parallel;

feed connection paths, one of said feed connection paths connected between one of said intermediate storage units and said feed transport device;

receiving devices;

removal connection paths, one of said removal connection paths connected between one of said intermediate storage units and one of said receiving devices;

said measuring device measuring, for an object, a value of the sorting feature for the object;

said control device selecting one of said intermediate storage units for each of the objects in accordance with the value of the sorting feature measured;

said feed transport device transporting the object to said feed connection path leading to said intermediate storage unit selected for the object;

each of said feed connection paths transporting the object to an assigned said intermediate storage unit;

said removal connection paths transporting the object from said assigned intermediate storage unit to one of said receiving devices;

the sorting system programmed to carrying out the following steps for each of the objects:

measure, via said measuring device, the value of the sorting feature for the object;

select automatically, via said control device, said intermediate storage unit in accordance with the value of the sorting feature measured;

transport, via said feed transport device, the object to said feed connection path of said intermediate storage unit selected;

redirecting, via the sorting system, the object into said selected feed connection path;

transport, via said feed connection path, the object to said intermediate storage unit selected;

subsequently transport, via said removal connection path, the object from said intermediate storage unit to said receiving device;

transport, via said feed transport device, the objects in such a way that a sequence of the transported objects is formed, and, for each of said intermediate storage units, the objects are transported from said intermediate storage units into said receiving device in such a way that all the objects from said intermediate storage unit are disposed directly one behind the other in said receiving device;

detect a last object in the sequence of the objects transported in said feed transport device via said measuring device;

said control device configured to control each of said intermediate storage units such that for each of said intermediate storage units, a procedure of emptying said intermediate storage unit is triggered, when the last object in a sequence of transported objects transported in said feed transport device has been transported into said intermediate storage unit because said intermediate storage unit was selected for the sorting feature value of the object, or the object in said feed connection path has been transported past said intermediate storage unit because a subsequent said intermediate storage unit in the series of said intermediate storage units was selected for the sorting feature value of the object; and the sorting system configured such that the emptying of said intermediate storage unit comprises transporting, via said removal connection path of said intermediate storage unit, all the objects in said intermediate storage unit to said receiving device.

9. The sorting system according to claim 8, wherein each of said intermediate storage units operates by a "first in/first out" principle.

10. The sorting system according to claim 8, wherein said control device is programmed to:

determine, for at least one of said intermediate storage units, an occurrence of an event, whereby the last object in the sequence of the objects transported in said feed transport device, of which the sorting feature value is assigned to said intermediate storage unit, has been redirected from said feed transport device into said intermediate storage unit and has reached said intermediate storage unit; and trigger the step of emptying completely said intermediate storage unit when the occurrence of the event is determined.

* * * * *